US008904977B2

(12) United States Patent
Werler et al.

(10) Patent No.: US 8,904,977 B2
(45) Date of Patent: Dec. 9, 2014

(54) VALVE DRIVE FOR INTERNAL COMBUSTION ENGINES FOR ACTUATING GAS EXCHANGE VALVES

(75) Inventors: Andreas Werler, Zwickau (DE); Joerg Wutzler, Zwickau (DE); Uwe Parsche, Chemnitz (DE); Thomas Arnold, Mitteldorf (DE); Jochen Luedemann, Chemnitz (DE)

(73) Assignee: IAV GmbH Ingenieurgesellschaft Auto und Verkehr, Berlin (DE)

( * ) Notice: Subject to any disclaimer, the term of this patent is extended or adjusted under 35 U.S.C. 154(b) by 86 days.

(21) Appl. No.: 13/557,431

(22) Filed: Jul. 25, 2012

(65) Prior Publication Data

US 2013/0025554 A1 Jan. 31, 2013

(30) Foreign Application Priority Data

Jul. 27, 2011 (DE) ..... 10 2011 108 728

(51) Int. Cl.
*F01L 1/34* (2006.01)
*F01L 13/00* (2006.01)
*F01L 1/047* (2006.01)

(52) U.S. Cl.
CPC ..... *F01L 13/0036* (2013.01); *F01L 2001/0473* (2013.01); *F01L 2001/0476* (2013.01)
USPC ..... 123/90.16; 123/90.18

(58) Field of Classification Search
USPC ..... 123/90.15–90.18, 90.27, 90.31, 90.6
See application file for complete search history.

(56) References Cited

U.S. PATENT DOCUMENTS

| | | | | |
|---|---|---|---|---|
| 3,481,314 | A | 12/1969 | Lecrenn | |
| 4,151,817 | A | 5/1979 | Mueller | |
| 4,353,334 | A | 10/1982 | Neitz | |
| 4,354,460 | A | 10/1982 | Mae et al. | |
| 4,516,542 | A | 5/1985 | Aoyoma et al. | |
| 4,534,323 | A | 8/1985 | Kato et al. | |
| 4,643,141 | A * | 2/1987 | Bledsoe | 123/90.16 |
| 5,289,806 | A * | 3/1994 | Hurr | 123/90.17 |
| 5,737,975 | A * | 4/1998 | Hanisch et al. | 74/567 |
| 6,382,149 | B1 | 5/2002 | Fischer et al. | |
| 6,915,768 | B2 | 7/2005 | Ohsawa | |

(Continued)

FOREIGN PATENT DOCUMENTS

| | | | |
|---|---|---|---|
| DE | 3934848 | A1 | 4/1991 |
| DE | 4107624 | A1 | 9/1992 |

(Continued)

*Primary Examiner* — Thomas Denion
*Assistant Examiner* — Steven D Shipe
(74) *Attorney, Agent, or Firm* — Leydig, Voit & Mayer, Ltd.

(57) ABSTRACT

A valve drive device for switching the stroke of gas exchange valves of an internal combustion engine includes a camshaft configured, at least in part, as a hollow shaft. A cam unit includes at least two different cams disposed on the camshaft so as to be rotationally engaged and axially displaceable with respect thereto. An adjustment sleeve is disposed so as to be rotationally engaged on an adjustment shaft and rotatable and axially displaceable inside the camshaft. The adjustment sleeve includes thereon a closed adjustment contour extending about a circumference of the adjustment sleeve and is operatively connected to the cam unit through an adjustment clearance in the camshaft via a first coupling element configured to permanently engage in the adjustment contour. A further coupling element is configured to permanently engage in the adjustment contour and connect to the camshaft so as to be fixed in position.

10 Claims, 1 Drawing Sheet

(56) References Cited

U.S. PATENT DOCUMENTS

| | | | | |
|---|---|---|---|---|
| 7,198,015 | B2 * | 4/2007 | Mobley | 123/90.18 |
| 7,409,938 | B2 * | 8/2008 | Dengler | 123/90.18 |
| 8,230,833 | B2 | 7/2012 | Werler et al. | |
| 8,307,797 | B2 * | 11/2012 | Meintschel et al. | 123/90.18 |
| 2008/0236531 | A1 | 10/2008 | Yamamoto et al. | |
| 2010/0242884 | A1 | 9/2010 | Meintschel et al. | |
| 2011/0180029 | A1 | 7/2011 | Arnold et al. | |
| 2012/0125273 | A1 | 5/2012 | Werler et al. | |
| 2012/0125274 | A1 * | 5/2012 | Werler et al. | 123/90.15 |
| 2012/0138001 | A1 | 6/2012 | Werler et al. | |
| 2012/0291731 | A1 * | 11/2012 | Parsche | 123/90.15 |

FOREIGN PATENT DOCUMENTS

| | | | |
|---|---|---|---|
| DE | 4230877 | A1 | 4/1993 |
| DE | 4416505 | A1 | 11/1995 |
| DE | 19520117 | A1 | 12/1996 |
| DE | 19700736 | A1 | 7/1998 |
| DE | 19825307 | A1 | 12/1999 |
| DE | 10054623 | A1 | 5/2002 |
| DE | 10148243 | A1 | 4/2003 |
| DE | 102004022849 | A1 | 12/2005 |
| DE | 102004033800 | A1 | 2/2006 |
| DE | 102004056290 | A1 | 6/2006 |
| DE | 102007016977 | A1 | 10/2008 |
| DE | 102007027979 | A1 | 1/2009 |
| DE | 102007054978 | A1 | 5/2009 |
| DE | 102007061353 | A1 * | 6/2009 |
| DE | 102009007263 | A1 | 8/2010 |
| DE | 102009037270 | A1 | 3/2011 |
| DE | 102009039733 | A1 | 3/2011 |
| DE | 102009037268 | B3 | 4/2011 |
| DE | 102010005790 | A1 | 7/2011 |
| DE | 102009017242 | B4 | 9/2011 |
| DE | 102010014249 | A1 | 10/2011 |
| EP | 0579592 | A1 | 1/1994 |
| EP | 2196638 | A1 | 6/2010 |
| JP | 55131515 | A | 10/1980 |
| JP | 2003003811 | A | 1/2003 |
| JP | 2005155555 | A | 6/2005 |
| WO | WO 2007052686 | A1 | 5/2007 |
| WO | WO 2011018074 | A2 * | 2/2011 |
| WO | 2011026562 | A1 | 3/2011 |

* cited by examiner

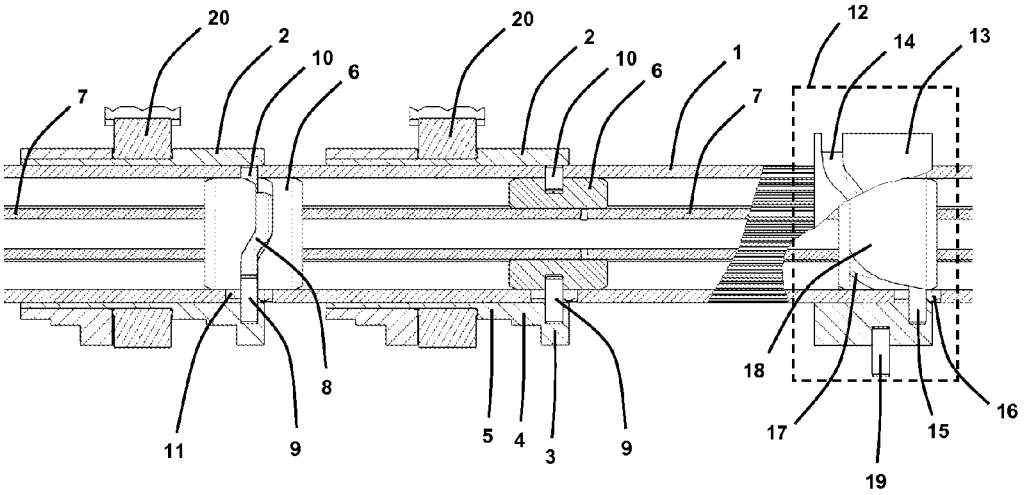
20
2
10
6
7
20
2
10
6
1
7
12
14
13
8
11
9
5
4
3
9
18
17
19
15
16

VALVE DRIVE FOR INTERNAL COMBUSTION ENGINES FOR ACTUATING GAS EXCHANGE VALVES

CROSS-REFERENCE TO PRIOR APPLICATION

Priority is claimed to German Patent Application No. DE 10 2011 108 728.5 filed on Jul. 27, 2011, the entire disclosure of which is hereby incorporated by reference herein.

FIELD

The present invention relates to a valve drive device for gas exchange valves of internal combustion engines.

BACKGROUND

Valve drive devices are already known which have a means for switching the stroke of gas exchange valves. The invention is based on a valve drive in which the gas exchange valves, in particular inlet valves and outlet valves of an internal combustion engine, are actuated directly or indirectly by means of a camshaft. For switching the valve stroke, cams which are adjacent on the camshaft are provided with different cam shapes, which are combined to form a cam unit. By axially displacing the cam units on the camshaft, the stroke of the gas exchange valves is altered in accordance with the contour of the cams. For the displacement of the cam units, an adjustment shaft which extends parallel to the camshaft is provided with corresponding elements for engagement on the cam units.

DE 10 2009 037 268 B3 discloses a variable valve drive for actuating gas exchange valves for internal combustion engines, in which the camshaft is constructed from a plurality of individual cam sleeves which can be displaced relative to one another. The cam sleeves, which are positioned side by side, are interconnected by means of an axially extending toothing, in that the toothings of adjacent cam sleeves engage in one another. On each cam sleeve, a plurality of different cam profiles having the same base circle are provided side by side, and can be brought into engagement with the respective gas exchange valve in succession by way of the axial displacement of the cam sleeves, and thus result in different actuations of the gas exchange valve. For the axial displacement of the cam sleeves, a switching shaft, which is mounted so as to be rotatable but axially undisplaceable relative to the camshaft, is arranged in the interior of the camshaft and is operatively connected to the cam sleeves by means of a switching ball, and the switching ball on the one hand is mounted so as to be fixed in position in the cam sleeve and on the other hand runs in a switching contour on the switching shaft. The switching contour has an axial inclination, in such a way that the cam sleeves are axially displaced when the switching shaft is rotated relative to the camshaft, and it is thus possible to switch between the different cam profiles of a cam sleeve so as to actuate the respective gas exchange valve.

DE 10 2009 039 733 A1 discloses a valve drive for gas exchange valves of an internal combustion engine, in which a cam unit, comprising a plurality of different cam paths which are arranged side by side, is mounted on a camshaft so as to be rotationally engaged and axially displaceable, and the cam unit is axially displaceable by means of an adjustment means. The adjustment means comprises an adjustment element, which is mounted so as to be movable inside the camshaft, for transmitting the adjustment movement to the cam unit. For this purpose, the adjustment element comprises on the circumference thereof a running path profile, which cooperates with a coupling element, and the coupling element is further connected to the cam unit through a clearance in the camshaft. Moving the adjustment element relative to the camshaft brings about an axial displacement of the cam unit on the camshaft. As a variant embodiment, it is disclosed that the adjustment element is mounted so as to be rotatable in the camshaft, and that the running path profile extends substantially in the circumferential direction on the adjustment element. The change between two cam paths on the cam unit for the actuation of the gas exchange valves is achieved by way of an axial offset in the running path profile, which results from a rotation of the adjustment element relative to the camshaft.

SUMMARY

In an embodiment, the present invention provides a valve drive device for switching the stroke of gas exchange valves of an internal combustion engine. At least one camshaft is configured, at least in part, as a hollow shaft. At least one cam unit includes at least two different cams disposed on the at least one camshaft so as to be rotationally engaged and axially displaceable with respect thereto. At least one adjustment sleeve is disposed so as to be rotationally engaged on an adjustment shaft and so as to be rotatable and axially displaceable inside the at least one camshaft. The at least one adjustment sleeve includes thereon a closed adjustment contour extending about a circumference of the at least one adjustment sleeve and is operatively connected to the at least one cam unit through an adjustment clearance in the at least one camshaft via a first coupling element configured to permanently engage in the adjustment contour. A further coupling element is configured to permanently engage in the adjustment contour and connect to the at least one camshaft so as to be fixed in position.

BRIEF DESCRIPTION OF THE DRAWING

The present invention will be described in even greater detail below based on the exemplary, schematic FIGURE. The invention is not limited to the exemplary embodiments. Features described and/or represented in the FIGURE can be used alone or combined in embodiments of the present invention. Other features and advantages of various embodiments of the present invention will become apparent by reading the following detailed description with reference to the attached drawing which illustrates the following:

FIG. 1 is a schematic drawing of an embodiment of the valve drive device according to the invention.

DETAILED DESCRIPTION

In an embodiment, invention provides a device for a valve drive for switching the stroke of gas exchange valves of an internal combustion engine, it being possible to reduce the required constructional space, the technical complexity and the mechanical loads and to increase the operational reliability.

An embodiment of the invention provides a device with which the stroke of gas exchange valves can be switched in a particularly advantageous manner. For this purpose, the valve drive according to an embodiment of the invention is constructed at least from a camshaft, from at least one cam unit which is mounted thereon, and from an adjustment shaft, in addition to connecting elements between the adjustment shaft, the cam unit and the camshaft.

The camshaft is mounted in a housing, directly or indirectly via the cam units which are arranged on the camshaft, so as to be rotatable in a plurality of camshaft bearings. The camshaft is mounted so as to be undisplaceable relative to the gas exchange valves. A housing may refer to a cylinder head, a ladder frame, modules or other means for accommodating a valve drive. On the camshaft, a cam unit is associated with at least one gas exchange valve of the internal combustion engine, and consists at least of two adjacent different cams, which differ in terms of the cam shape or cam contour and/or cam elevation thereof. The different cams of a cam unit are only identical in the region of the base circle of the individual cam, so as to make it possible to switch between the cams during the base circle phase. The cam unit is connected to the camshaft so as to be rotationally engaged and axially undisplaceable. The rotational engagement between the camshaft and the cam unit can advantageously be achieved by means of a toothing. One of the cams of the cam unit may also be configured as a zero stroke cam for switching off a valve.

At least one adjustment sleeve, which is allocated to a cam shaft, is mounted on the adjustment shaft so as to be rotationally engaged but axially displaceable. Together with the adjustment shaft, the at least one adjustment sleeve is mounted rotatably inside the cam shaft, which is configured as a hollow shaft at least in part. This results in a coaxial construction of the adjustment shaft, the adjustment sleeve and the camshaft.

A cam unit is associated with each gas exchange valve of which the stroke is to be switched in accordance with the different cams, and actuates the gas exchange valve directly or indirectly via at least one interposed lever arrangement. Advantageously, the cam units, which are adjacent on a camshaft, of the gas exchange valves of a cylinder can be combined to form a shared double cam unit. Each cam unit or double cam unit is operatively connected by means of a coupling element to an associated adjustment sleeve through a corresponding clearance in the camshaft. On the adjustment sleeve, there is a radially circumferential and closed adjustment contour for this purpose, which produces an axial adjustment stroke. The adjustment contour may for example be constructed in the form of a groove having a rectangular or else semi-circular cross-section. Other forms of the adjustment contour are also conceivable. Further, a plurality of axially spaced, identical or different adjustment contours may also be provided on the adjustment sleeve. A coupling element may in general refer to an element which is suitable for cooperating with the adjustment contour and can slide with a low friction. The coupling element may for example be configured as a stud, pin or ball.

The coupling element is on the one hand rigidly connected to the cam unit, and on the other hand permanently engaged with the adjustment contour. Furthermore, a further coupling element is provided for each adjustment sleeve, and is on the one hand connected to the camshaft so as to be fixed in position, and on the other hand permanently engaged with the adjustment contour. This results in reliable positioning of the cam unit relative to the camshaft. A connection of the further coupling element to the camshaft so as to be fixed in position refers to a connection in which the further coupling element cannot be displaced or rotated, either axially or in the circumferential direction relative to the camshaft. If the further coupling element is fixed in position in the camshaft, the connection may also be referred to as an engagement with the camshaft.

The cam unit is fixed in rotation on the camshaft by means of a guide, and is positioned axially relative to the camshaft by means of the two coupling elements via the adjustment sleeve, since the adjustment sleeve is supported by means of the further coupling element so as to be engaged with the cam shaft. For this purpose, the coupling elements are arranged with radial spacing, in such a way that during corresponding rotation of the adjustment shaft relative to the camshaft and thus relative to the adjustment sleeve, an axial offset is produced between the coupling elements, and the cam unit is axially displaced relative to the camshaft in accordance with the adjustment stroke which is produced by the contour. In this context, the axial stroke of the adjustment contour has to be at least half as large as the required adjustment path for switching between two cams of a cam unit. For this purpose, a minimum spacing of the coupling elements over the circumference of the adjustment sleeve is required, so as to keep the accelerations and thus the loads inside the adjustment contour for a switching process low. Alternatively, the radial positions of the two coupling elements may be mutually independent if two adjustment contours are used on an adjustment sleeve. The coupling elements may then be positioned for example in the same position in the radial direction but with axial spacing in accordance with the adjustment contours.

If more than two cams between which it is intended to switch are provided in a cam unit, the adjustment contour in the adjustment sleeve should be stepped down accordingly. In this way, it is possible to switch between the cams of a cam group in sequence.

This results in a compact construction which saves an extremely large amount of constructional space.

The embodiment of the valve drive device according to the invention shown in FIG. 1 comprises a camshaft (1), which is mounted so as to be rotatable and axially undisplaceable, and on which there is at least one cam unit (2) comprising three axially spaced cams (3, 4, 5), a first cam (3), a second cam (4) or a third cam (5) of the camshaft (1) differing from the other cams (3, 4, 5) of the cam unit (2) in terms of the cam shape, cam contour or cam elevation thereof. An adjustment sleeve (6) is mounted in the interior of the camshaft (1), which is configured as a hollow shaft, and an adjustment shaft (7) is mounted inside the adjustment sleeve (6). This results in a coaxial construction of the adjustment shaft (7), the adjustment sleeve (6) and the camshaft (1). A circumferential adjustment contour (8) having an axial stroke is provided on the adjustment sleeve (6). In the adjustment contour (8), two coupling elements (9, 10) are engaged, a first coupling element (9) being connected to the cam unit (2) via an adjustment clearance (11) in the camshaft (1), and a radially spaced further coupling element (10) being connected to the camshaft (1). Alternatively, a further adjustment contour may also be provided on the adjustment sleeve (6), in which the further coupling element (10) permanently engages. In this way, a separate adjustment contour (8) is available for each of the two coupling elements (9, 10).

Furthermore, a rotation device (12) for the adjustment shaft (7) is provided so as to rotate the adjustment shaft (7) together with the adjustment sleeve (6) and thus to bring about an axial displacement of the cam unit (2). The rotation device (12) consists of an actuator disc piece (13), which is mounted on the camshaft (1) by means of a toothing so as to be fixed in rotation but axially displaceable and which has a closed actuator disc piece contour (14) which extends over the circumference. On the inside of the actuator disc piece (13), which is formed as a sleeve, an actuator coupling element (15) is provided, which engages in an adjustment shaft contour (17) via an actuator recess (16) in the camshaft (1). The adjustment shaft contour (17) is positioned directly on the adjustment shaft (7), or may be connected to the adjustment shaft (7) via an adjustment shaft sleeve (18), on the circumference of which the adjustment shaft contour (17) is attached and which is mounted rigidly on the adjustment shaft (7).

An actuator pin (19), which is fixed in relation to the housing, projects into the actuator disc piece (13) and runs in the actuator disc piece contour (14), and this results in an axial displacement of the actuator disc piece (13). As a result of the axial displacement of the actuator disc piece (13), the actuator coupling element (15) in the adjustment shaft contour (17) leads to a rotation of the adjustment shaft (1). The rotation of the adjustment shaft (4) brings about a rotation of the adjustment sleeve (6), and as a result the cam unit (2) is axially displaced. For the mounting of the camshaft (1) as a whole, either camshaft bearings may be provided, or the camshaft (1) is mounted in an appropriate mounting position by means of a sliding bearing (20) via the cam unit (2), as in the present embodiment.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

LIST OF REFERENCE NUMERALS

1 camshaft
2 cam unit
3 first cam
4 second cam
5 third cam
6 adjustment sleeve
7 adjustment shaft
8 adjustment contour
9 first coupling element
10 further coupling element
11 adjustment clearance
12 rotation device
13 actuator disc piece
14 actuator disc piece contour
15 actuator coupling element
16 actuator clearance
17 adjustment shaft contour
18 adjustment shaft sleeve
19 actuator pin
20 sliding bearing

The invention claimed is:

1. A valve drive device for switching the stroke of gas exchange valves of an internal combustion engine comprising:

at least one camshaft configured, at least in part, as a hollow shaft;

at least one cam unit including at least two different cams disposed on the at least one camshaft so as to be rotationally engaged and axially displaceable with respect thereto;

at least one adjustment sleeve disposed so as to be rotationally engaged on an adjustment shaft and so as to be rotatable and axially displaceable inside the at least one camshaft, the at least one adjustment sleeve including thereon a closed adjustment contour extending about a circumference of the at least one adjustment sleeve and being operatively connected to the at least one cam unit through an adjustment clearance in the at least one camshaft via a first coupling element configured to permanently engage in the adjustment contour; and a further coupling element configured to permanently engage in the adjustment contour and connect to the at least one camshaft so as to be fixed in position.

2. The valve drive device according to claim 1, further comprising a rotation device operatively connected to the at least one camshaft and the adjustment shaft so as to rotate, by the rotation device, the adjustment shaft between a first position and a further position and axially displace the at least one cam unit.

3. The valve drive device according to claim 1, wherein the at least one camshaft is mounted in a housing by a sliding bearing via the at least one cam unit so as to be rotatable.

4. The valve drive device according to claim 1, further comprising a rotation device configured to rotate the adjustment shaft, the rotation device including an actuator disc piece formed as a sleeve and disposed so as to be rotationally engaged but axially displaceable on the at least one camshaft, the actuator disc piece including thereon a closed actuator disc piece contour extending about a circumference of the actuator disc piece, the rotation device including an actuator coupling element disposed on an inside of the actuator disc piece and engaging in an adjustment shaft contour via an actuator clearance in the at least one camshaft.

5. The valve drive device according to claim 4, wherein the adjustment shaft contour is disposed directly on the adjustment shaft or is connected to the adjustment shaft via an adjustment shaft sleeve mounted rigidly on the adjustment shaft with the adjustment shaft contour being disposed on and extending about a circumference of the adjustment shaft sleeve.

6. A valve drive device for switching the stroke of gas exchange valves of an internal combustion engine comprising:

at least one camshaft configured, at least in part, as a hollow shaft;

at least one cam unit including at least two different cams disposed on the at least one camshaft so as to be rotationally engaged and axially displaceable with respect thereto;

at least one adjustment sleeve disposed so as to be rotationally engaged on an adjustment shaft and so as to be rotatable and axially displaceable inside the at least one camshaft, the at least one adjustment sleeve including thereon a closed adjustment contour extending about a circumference of the at least one adjustment sleeve and being operatively connected to the at least one cam unit through an adjustment clearance in the at least one camshaft via a first coupling element configured to permanently engage in the adjustment contour; and a further coupling element configured to permanently engage in a further adjustment contour disposed on the at least one adjustment sleeve and operatively connect to the camshaft.

7. The valve drive device according to claim 6, further comprising a rotation device operatively connected to the at least one camshaft and the adjustment shaft so as to rotate, by the rotation device, the adjustment shaft between a first position and a further position and axially displace the at least one cam unit.

8. The valve drive device according to claim 6, wherein the at least one camshaft is mounted in a housing by a sliding bearing via the at least one cam unit so as to be rotatable.

9. The valve drive device according to claim 6, further comprising a rotation device configured to rotate the adjustment shaft, the rotation device including an actuator disc piece formed as a sleeve and disposed so as to be rotationally engaged but axially displaceable on the at least one camshaft, the actuator disc piece including thereon a closed actuator disc piece contour extending about a circumference of the actuator disc piece, the rotation device including an actuator coupling element disposed on an inside of the actuator disc piece and engaging in an adjustment shaft contour via an actuator clearance in the at least one camshaft.

10. The valve drive device according to claim 9, wherein the adjustment shaft contour is disposed directly on the adjustment shaft or is connected to the adjustment shaft via an adjustment shaft sleeve mounted rigidly on the adjustment shaft with the adjustment shaft contour being disposed on and extending about a circumference of the adjustment shaft sleeve.

* * * * *